US009122210B2

(12) United States Patent
Tomino

(10) Patent No.: US 9,122,210 B2
(45) Date of Patent: Sep. 1, 2015

(54) COOLING DEVICE AND IMAGE FORMING APPARATUS

(71) Applicant: Konica Minolta, Inc., Tokyo (JP)

(72) Inventor: Toshiaki Tomino, Hachioji (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/203,704

(22) Filed: Mar. 11, 2014

(65) Prior Publication Data

US 2014/0270878 A1 Sep. 18, 2014

(30) Foreign Application Priority Data

Mar. 15, 2013 (JP) ..... 2013-053494

(51) Int. Cl.
*G03G 15/20* (2006.01)

(52) U.S. Cl.
CPC ..... *G03G 15/2021* (2013.01)

(58) Field of Classification Search
CPC ..... G03G 15/2017; G03G 15/2021; G03G 15/6573; G03G 15/20
See application file for complete search history.

(56) References Cited

U.S. PATENT DOCUMENTS

| | | | | |
|---|---|---|---|---|
| 2004/0146325 | A1* | 7/2004 | Tani et al. | 399/329 |
| 2010/0074663 | A1* | 3/2010 | Ichikawa | 399/341 |
| 2012/0057910 | A1* | 3/2012 | Matsumoto | 399/329 |
| 2012/0201579 | A1* | 8/2012 | Kunii et al. | 399/328 |
| 2012/0315069 | A1* | 12/2012 | Ikeda et al. | 399/341 |
| 2014/0270877 | A1* | 9/2014 | Tomino | 399/341 |
| 2014/0308057 | A1* | 10/2014 | Tomino | 399/341 |
| 2014/0334858 | A1* | 11/2014 | Miyagawa et al. | 399/341 |

FOREIGN PATENT DOCUMENTS

| | | | |
|---|---|---|---|
| JP | 2012167844 A | * | 9/2012 |
| JP | 2012173640 A | * | 9/2012 |
| JP | 2012-198502 A | | 10/2012 |

OTHER PUBLICATIONS

Machine translation of JP2012173640.*
Machine translation of JP2012167844.*

* cited by examiner

*Primary Examiner* — Clayton E Laballe
*Assistant Examiner* — Ruifeng Pu
(74) *Attorney, Agent, or Firm* — Cantor Colburn LLP

(57) ABSTRACT

A cooling section has a flow passage-forming section for forming a flow passage through which a cooling medium flows and cools a sheet via a first belt. A pressing roller is provided inside a second belt, faces the flow passage-forming section via the second belt and the first belt, and presses the second belt onto the cooling section.

7 Claims, 6 Drawing Sheets

COOLING DEVICE AND IMAGE FORMING APPARATUS

CROSS REFERENCES TO RELATED APPLICATIONS

The present invention contains subject matter related to Japanese Patent Applications JP 2013-053494, filed in the Japanese Patent Office on Mar. 15, 2013, respectively, the entire contents of which being incorporated herein by reference.

BACKGROUND OF THE INVENTION

1. Field of the Invention

The present invention relates to a cooling device for cooling sheets and an image forming apparatus provided with the cooling device.

2. Description of the Related Art

Conventionally, there has been known a cooling device that is used in an image forming apparatus and that cools sheets heated by a fixing device.

Patent Literature 1 discloses a heat exchanging device provided in the image forming apparatus. This heat exchanging device is provided with a cooling belt for feeding sheets and a liquid cooling-type cooling plate where six flow channels through which cooling water flows are provided side by side in a sheet feeding direction and where the flow channels are connected by a connecting pipe. In addition, in this heat exchanging device, in the flow channel on the most upstream side in the sheet feeding direction in the six flow channels, there is provided an inlet through which the cooling water flows in is provided, and in the flow channel on the most downstream side in the same direction, there is provided an outlet through which the cooling water is discharged. By the contact of the sheet with the cooling plate via the cooling belt, heat of the sheet is transmitted to the cooling water flowing through the flow channel, and the sheet is cooled.

CITATION LIST

Patent Literature

[Patent Literature 1] Japanese Patent Laid-Open No. 2012-198502

SUMMARY OF THE INVENTION

Problems to be Solved by the Invention

However, in the heat exchanging device disclosed in Patent Literature 1, the cooling water flowing into the flow channel through the inlet is warmed by the sheet at a relatively high temperature immediately after reaching the heat exchanging device, and the warmed cooling water flows through the flow channel. Therefore, cooling efficiency is poor, and it is likely that sheets cannot be efficiently cooled.

The present invention has been made in view of the aforementioned circumstances and has an object to provide a cooling device that can efficiently cool sheets and an image forming apparatus provided with the cooling device.

Means for Solving the Problems

To achieve at least one of the abovementioned objects, a cooling device reflecting one aspect of the present invention is a cooling device used in an image forming apparatus and is provided with a feeding portion, a cooling portion, and a pressing roller. The feeding portion has endless first belt and second belt facing each other and feeds a sheet by sandwiching it between the first belt and the second belt. The cooling portion has a flow passage-forming portion forming a flow passage through which a cooling medium flows and cools the sheet via the first belt. The pressing roller is provided inside the second belt, faces the flow passage-forming portion via the second belt and the first belt, and presses the second belt onto the cooling portion.

Furthermore, the image forming apparatus reflecting one aspect of the present invention is provided with the aforementioned cooling device.

DESCRIPTION OF THE PREFERRED EMBODIMENTS

First Embodiment

Figure 1:
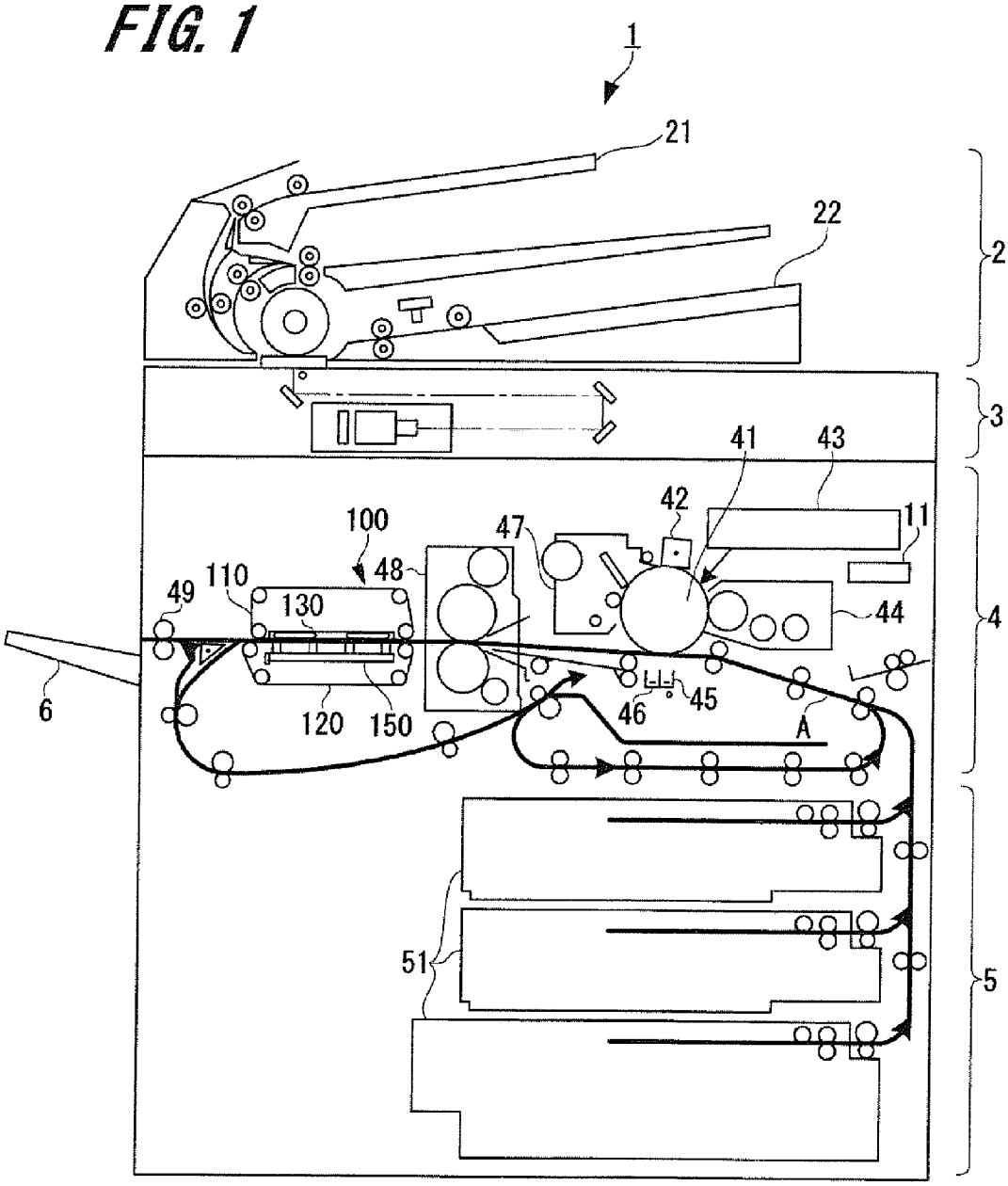
FIG. 1 is an outline diagram illustrating an entire configuration of an image forming apparatus according to a first embodiment of the present invention.

Hereinafter, a first embodiment of the present invention will be described by referring to FIGS. 1 to 5. Meanwhile, in each of the figures, the same reference numerals are attached to members that are common.

[Configuration of Image Forming Apparatus]

FIG. 1 illustrates a schematic cross-sectional view of an image forming apparatus 1 according to the first embodiment of the present invention. The image forming apparatus 1 is provided with functions as a copying machine, a printer, a facsimile machine and the like and forms a monochromic image on a sheet by electrophotography.

The image forming apparatus 1 can be connected to an external device not shown, for example, a personal computer, and obtains image data from the external device.

The image forming apparatus 1 is provided with a manuscript feeding section 2, a manuscript reading section 3, an image forming section 4, a paper-feeding cassette section 5, and a paper discharge tray 6. Meanwhile, in the image forming apparatus 1, a feeding path A for sheets from the paper-feeding cassette section 5 to the paper discharge tray 6 via the image forming section 4 is formed of various rollers, a guide plate, a feeding belt and the like provided at predetermined positions.

The manuscript feeding section 2 is to feed a manuscript to the manuscript reading section 3 for continuous reading of the manuscript and has a manuscript feeding tray 21 and a manuscript discharge tray 22. The manuscript feeding section 2 feeds the manuscript set on the manuscript feeding tray 21 to a predetermined reading position of the manuscript reading section 3. Furthermore, after the manuscript reading section 3 reads the manuscript fed to the predetermined reading position, the manuscript feeding section 2 feeds this manuscript to the manuscript discharge tray 22.

The manuscript reading section 3 optically reads a manuscript image, converts information of the manuscript image into an analog electric signal and further converts the analog electric signal into a digital signal. The manuscript reading section 3 outputs the converted digital signal to a control section 11 which will be described later, as image data.

The image forming section 4 has a drum-shaped photoreceptor 41, a charging section 42 provided in the periphery of the photoreceptor 41 as an image forming function part, an image writing section 43, a developing section 44, a transfer section 45, a separation section 46, and a cleaning section 47. Furthermore, the image forming section 4 has a fixation section 48, a cooling device 100, and a paper discharge roller 49. In addition, in the image forming section 4, the image forming function part including the photoreceptor 41 and each of the aforementioned sections provided in the periphery thereof, the fixation section 48, the cooling device 100, and the paper discharge roller 49 are arranged in this order from an upstream side of the feeding path A for the sheet.

The charging section 42 uniformly charges the surface of the photoreceptor 41 by applying a predetermined voltage to the photoreceptor 41. The image writing section 43 obtains the image data to which predetermined image processing is applied, from the control section 11 which will be described later, and forms an electrostatic latent image on the photoreceptor by performing irradiation with a laser beam on the basis of the obtained image data.

The developing section 44 generates a toner image on the photoreceptor 41 by performing reversal development of the electrostatic latent image formed on the photoreceptor 41. The sheet is fed so as to synchronize with rotation of the photoreceptor 41 on which the toner image is generated, and the transfer section 45 transfers, to the sheet, the toner image formed on the photoreceptor 41 by applying a predetermined voltage from a back surface side of the feeding belt for feeding the sheet.

The separation section 46 separates the sheet from the photoreceptor 41 by removing electricity of the sheet to which the toner image is transferred. Subsequently, the sheet to which the toner image is transferred is fed to the fixation section 48.

The fixation section 48 melts a toner of the transferred toner image by heating the sheet, and pressurizes the sheet to thereby fix the toner image on the sheet. The sheet is cooled by the cooling device 100, fed by the paper discharge roller 49, and placed on the paper discharge tray 6, or when an image is formed on both surfaces, the sheet is fed to the image forming function part again.

The paper-feeding cassette section 5 has a plurality of paper-feeding cassettes 51 corresponding to various sheets and feeds predetermined sheets accommodated in each of the paper-feeding cassettes 51 one by one to the image forming section 4 along the feeding path A.

Furthermore, the image forming apparatus 1 is provided with the control section 11. The control section 11 has a processing section including a CPU, not shown, and a storage section including a ROM, a RAM and the like and controls the total operation of the image forming apparatus 1. For example, the control section 11 executes image processing for the image data, display processing for displaying various types of information on a liquid crystal display section not shown, provided in the image forming apparatus 1 or drive processing of a pump 141 of the cooling device 100 which will be described later, in accordance with an instruction by a user or at a predetermined timing. Moreover, the control section 11 executes pressing force-adjusting processing for adjusting a pressing force of a feeding belt 120 by a pressing roller 151 of the cooling device 100 which will be described later, in accordance with an instruction by a user or at a predetermined timing.

[Configuration of Cooling Device 100]

Figure 2:
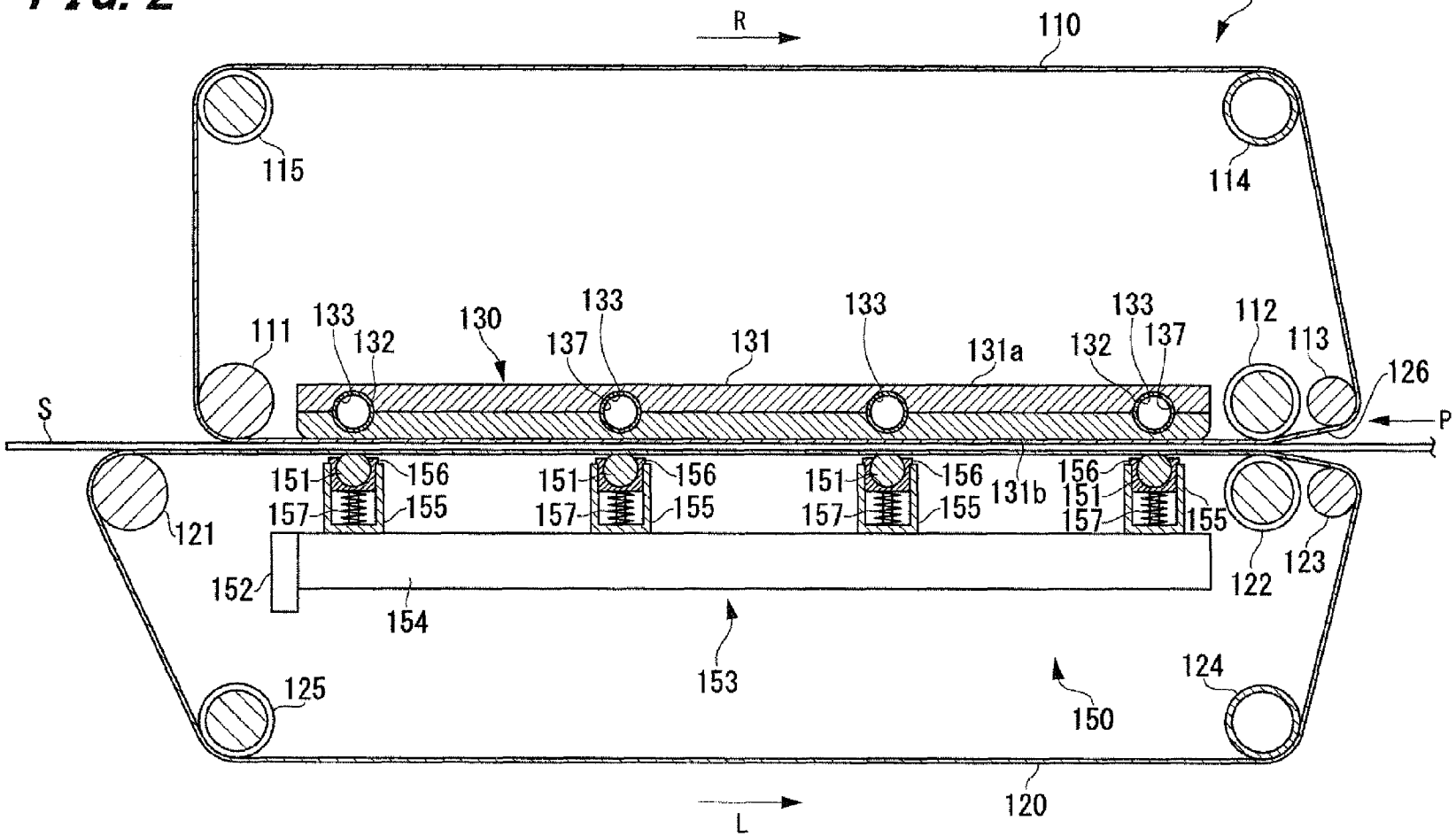
FIG. 2 is a cross-sectional view of an essential part, obtained by cutting, along a feeding direction of sheets, a cooling device according to the first embodiment of the present invention.
Figure 3:
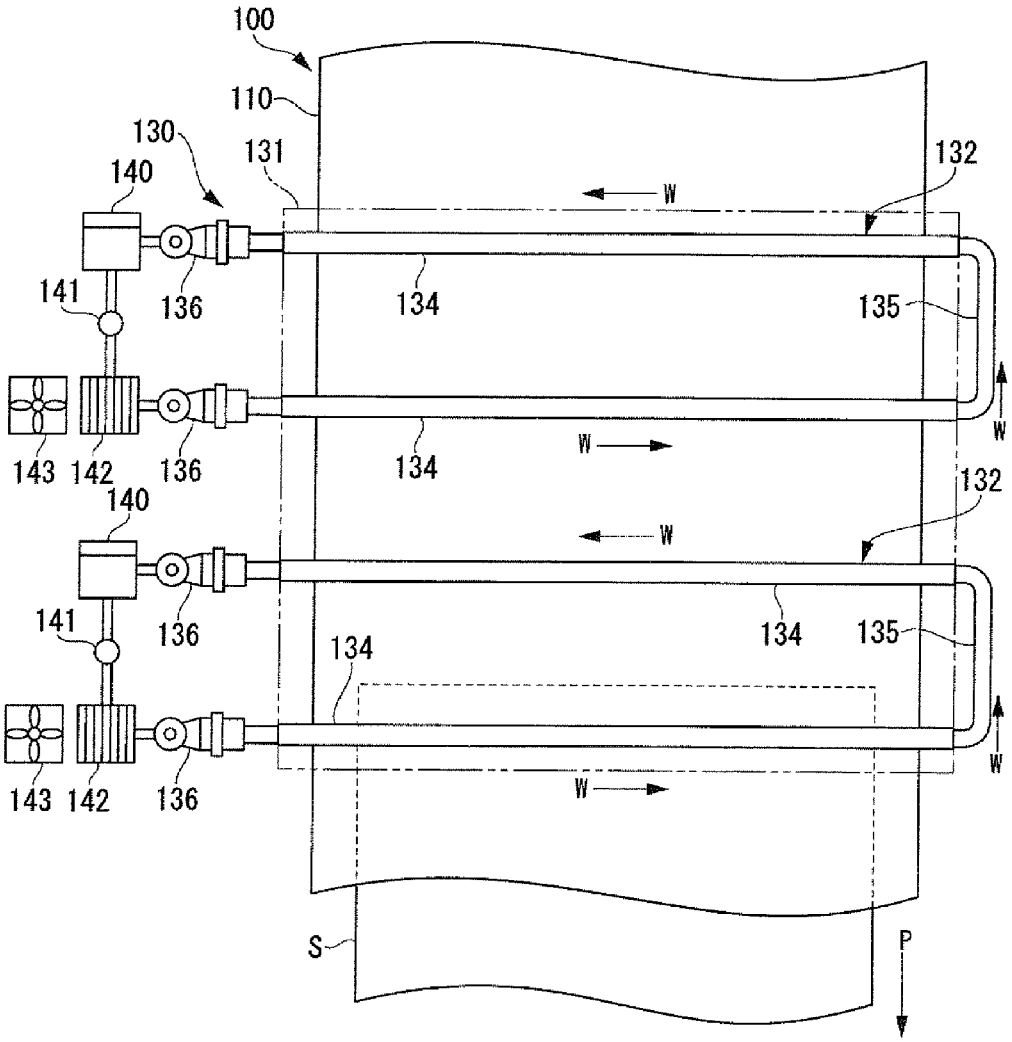
FIG. 3 is a top view of an essential part of the cooling device, when viewed from above, according to the first embodiment of the present invention.

Next, by referring to FIGS. 2 to 3, the cooling device 100 will be described. FIG. 2 is a cross-sectional portion of an essential part, obtained by cutting the cooling device 100 along the feeding direction of the sheet. FIG. 3 is a top view of an essential part of the cooling device 100 when viewed from above. Meanwhile, in FIGS. 2 to 3, S denotes a sheet and an arrow P indicates the feeding direction of the sheet.

As illustrated in FIGS. 2 and 3, the cooling device 100 has a cooling belt 110, the feeding belt 120, a cooling section 130, and a pressing unit 150.

The cooling belt 110 is an endless belt extended between a plurality of rollers extending in a direction orthogonal to the feeding direction of the sheet on a horizontal plane. In the present embodiment, the rollers between which the cooling belt 110 is extended are an upper driving roller 111, a first upper driven roller 112, an upper introduction roller 113, an upper steering roller 114, and a second upper driven roller 115.

The upper driving roller 111 is provided on the downstream side in the sheet feeding direction. Moreover, the upper driving roller 111 is connected to a rotation mechanism not shown. The first upper driven roller 112 is provided on the upstream side in the sheet feeding direction of the upper driving roller 111 at the same height position as that of the upper driving roller 111. The upper introduction roller 113 is provided on the upstream side in the sheet feeding direction of the first upper driven roller 112. The upper introduction roller 113 is arranged so that a lower end portion of the upper introduction roller 113 is located at a position higher than a lower end portion of the first upper driven roller 112. The upper steering roller 114 is provided above the first upper driven roller 112. The second upper driven roller 115 is provided at the same height position as that of the upper steering roller 114 above the upper driving roller 111. The cooling belt 110 is extended between these rollers in a substantially trapezoidal shape when viewed from the side and rotates in an arrow R direction in FIG. 2 along with rotation of the upper driving roller 111.

The feeding belt 120 is an endless belt extended between the plurality of rollers extending in the direction orthogonal to the sheet feeding direction on the horizontal plane and is provided below the cooling belt 110. In the present embodiment, the rollers between which the feeding belt 120 is extended are a lower driving roller 121, a first lower driven roller 122, a lower introduction roller 123, a lower steering roller 124, and a second lower driven roller 125.

The lower driving roller 121 is provided on the downstream side in the sheet feeding direction. In addition, the lower driving roller 121 is connected to the rotation mechanism, not shown. The first lower driven roller 122 is provided on the upstream side in the sheet feeding direction of the lower driving roller 121 at the same height position as that of the lower driving roller 121. The lower introduction roller 123 is provided on the upstream side in the sheet feeding direction of the first lower driven roller 122. The lower introduction roller 123 is arranged so that an upper end portion of the lower introduction roller 123 is located at a position lower than an upper end portion of the first lower driven roller 122. The lower steering roller 124 is provided below the first lower driven roller 122. The second lower driven roller 125 is provided below the lower driving roller 121 and at the same height position as that of the lower steering roller 124. The feeding belt 120 is extended between these rollers so as to have a substantially trapezoidal shape when viewed from the side and rotates in an arrow L direction in FIG. 2 along with rotation of the lower driving roller 121.

The cooling belt 110 and the feeding belt 120 are not in contact with each other in the vicinity of the upper introduction roller 113 and the lower introduction roller 123, and form an introduction port 126 for receiving the sheet fed from the upstream side of the feeding path A. In addition, outer peripheral surfaces of the cooling belt 110 and the feeding belt 120 facing each other are in contact in a region on the downstream side in the sheet feeding direction of the introduction port 126 and feed the sheet by sandwiching it in a contact region. As described above, the cooling belt 110 and the feeding belt 120 form a feeding section for feeding the sheet.

The cooling section 130 has, as illustrated in FIGS. 2 and 3, a cooling plate 131, a cooling pipe unit (flow passage-forming section) 132, a tank 140 (see FIG. 3), a pump 141 (see FIG. 3), a radiator 142, and a fan 143 (see FIG. 3).

The cooling plate 131 is a flat plate-shaped member formed of metal with good heat conductivity, that is, for example, aluminum or copper, and a plurality of or four fitting holes 133 in the present embodiment to be fitted with the cooling pipe unit 132 are provided therein. The fitting hole 133 is formed in a direction orthogonal to the sheet feeding direction on the horizontal plane. The cooling plate 131 is formed by preparing an upper member 131*a* and a lower member 131*b* which are two flat plate-shaped members, in each of which a groove having a semicircular cross-section is formed on one of surfaces and by crimping the upper member 131*a* and the lower member 131*b* so that the grooves face each other. Furthermore, the fitting hole 133 is formed by the grooves facing each other. Meanwhile, an inner diameter of the fitting hole 133 may be set slightly smaller than an outer diameter of a cooling pipe body 134 which will be described later of the cooling pipe unit 132, and a uniform projection may be provided at a section where the groove of the upper member 131*a* and the lower member 131*b* is formed. In this case, the projection bites into the cooling pipe body 134 and can eliminate a gap between the cooling pipe body 134 and the fitting hole 133 when the upper member 131*a* and the lower member 131*b* are crimped. Moreover, a concave portion (not shown) recessed upward may be formed at both end portions in the sheet feeding direction of the upper member 131*a*, a convex portion (not shown) projecting upward at both end portions in the sheet feeding direction of the lower member 131*b* may be formed, and the concave portion and the convex portion may be engaged with each other. Moreover, the cooling plate 131 may be formed by penetrating the fitting hole 133 in the side surface having a flat plate shape.

The cooling plate 131 is provided inside the cooling belt 110 and between the upper driving roller 111 and the first upper driven roller 112. A lower surface of the lower member 131*b* of the cooling plate 131 is in contact with an inner peripheral surface of the cooling belt 110 in a region where the respective outer peripheral surfaces of the cooling belt 110 and the feeding belt 120 are in contact with each other.

The cooling pipe unit 132 is a tubular member formed of metal with good heat conductivity, for example, aluminum or copper, and a flow passage 137 through which a cooling water flows is formed therein. In addition, as illustrated in FIG. 3, the cooling pipe unit 132 has two cooling pipe bodies 134, a joining section 135, and two connecting sections 136. In the present embodiment, in the cooling section 130, two sets of the cooling pipe units 132 are provided in parallel along the sheet feeding direction.

The cooling pipe body 134 extends in a direction orthogonal to the sheet feeding direction on the horizontal plane and is fitted into the fitting hole 133 of the cooling plate 131. The flow passage 137 formed inside the cooling pipe body 134 is referred to as a first flow passage.

The joining section 135 extends in the sheet feeding direction, is bent at both end portions in a direction orthogonal to the sheet feeding direction on the horizontal plane and is fixed to one end portion of the cooling pipe body 134. The joining section 135 joins the one end portions of the adjacent cooling pipe bodies 134 to each other. The flow passage 137 formed inside the joining section 135 is referred to as a second flow passage.

The connecting section 136 is provided on the other end portion of the cooling pipe body 134. In the cooling pipe bodies 134 joined by the joining section 135, the connecting section 136 provided on the cooling pipe body 134 arranged on the upstream side in the sheet feeding direction connects the cooling pipe body 134 to the tank 140. In addition, in the cooling pipe bodies 134 joined by the joining section 135, the connecting section 136 provided on the cooling pipe body 134 arranged on the downstream side in the sheet feeding direction connects the cooling pipe body 134 to the radiator 142.

The tank 140 accommodates the cooling water indicating a specific example of a cooling medium. The pump 141 has its driving controlled by the control section 11 and supplies the cooling water to the radiator 142 from the tank 140. The radiator 142 cools the cooling water by using the fan 143.

The cooling water supplied to the radiator 142 by the pump 141 flows into the flow passage 137 inside the cooling pipe unit 132 via the connecting section 136, and the cooling water having flowed flows through the flow passage 137. Specifically, the cooling water first flows through the cooling pipe body 134 arranged on the downstream side in the sheet feeding direction (first flow passage), and subsequently, flows through the joining section 135 (second flow passage) and flows through the cooling pipe body 134 arranged on the upstream side in the sheet feeding direction (first flow passage). Then, the cooling water is discharged from the flow passage 137 via the connecting section 136 and is stored in the tank 140. As described above, the pump 141 supplies the cooling water to the cooling pipe unit 132 so that the cooling water flows through the cooling pipe unit 132 from the downstream side to the upstream side in the sheet feeding direction. Meanwhile, an arrow W in FIG. 3 indicates a flowing direction of the cooling water.

The pressing unit 150 is, as illustrated in FIG. 2, provided inside the feeding belt 120 and between the lower driving roller 121 and the first lower driven roller 122. The pressing unit 150 presses an inner peripheral surface of the feeding belt 120 in a region where the respective outer peripheral surfaces of the cooling belt 110 and the feeding belt 120 come into contact with each other.

In addition, the pressing unit 150 has four pressing rollers 151 in contact with the feeding belt 120, a pressing base body 153 supporting the pressing roller 151, and a pressing driving mechanism 152 moving the pressing base body 153 in a vertical direction.

The pressing base body 153 has a body section 154, a guide section 155, and a bearing section 156. The body section 154 is formed having a flat plate shape and on an upper surface thereof, the bearing section 156 rotatably supporting the pressing roller 151, and the guide section 155 guiding movement in a vertical direction of the bearing section 156 are provided. The bearing section 156 is urged upward (to the cooling section 130 side) by a coil spring 157 fixed to the guide section 155.

The pressing driving mechanism 152 includes a motor, a gear and the like, not shown, whose driving is controlled by the control section 11, and moves the pressing base body 153 in the vertical direction. The control section 11 executes pressing force-adjusting processing during image formation. Specifically, the control section 11 controls driving of the pressing driving mechanism 152 in accordance with a sheet thickness stored preliminarily in response to paper-feeding cassette 51 accommodating the sheets to be fed, and moves the pressing base body 153 in the vertical direction. As a result, the pressing force onto the feeding belt 120 inputted by the pressing roller 151 is adjusted. For example, when an image is to be formed on a so-called cardboard, the pressing base body 153 is moved downward, and the pressing force of the pressing roller 151 is weakened. Because of this, there is reduced a load of the cooling belt 110 and the feeding belt 120 which feed the sheet while sandwiching it in the contact region.

The pressing roller 151 is a substantially columnar member formed of an elastic body, for example, rubber or a resin, and is formed in a crown shape having an outer diameter at a central part larger than that at an end portion in a rotation shaft direction. Meanwhile, the elastic body used for forming the pressing roller 151 is preferably an elastic body having a hardness of 60 degrees or less. When the pressing roller 151 formed of the elastic body having a hardness of 60 degrees or less is used, the sheet being fed can be sufficiently brought into close contact with the cooling plate 131.

Each of the four pressing rollers 151 is arranged at a position facing the cooling pipe body 134 via the feeding belt 120, the cooling belt 110, and the cooling plate 131. The pressing roller 151 is in contact with the inner peripheral surface of the feeding belt 120 in the region where the cooling belt 110 and the feeding belt 120 come into contact with each other on the respective outer peripheral surfaces.

A length in a direction (axial direction) orthogonal to the sheet feeding direction on the horizontal plane of the pressing roller 151 is set longer than the length in the same direction of the largest sheet fed to the cooling device 100. Furthermore, a length in the direction (axial direction) orthogonal to the sheet feeding direction on the horizontal plane of the pressing roller 151 is set shorter than the length in the same direction of the cooling plate 131.

[Arrangement of Pressing Roller]

Figure 4:
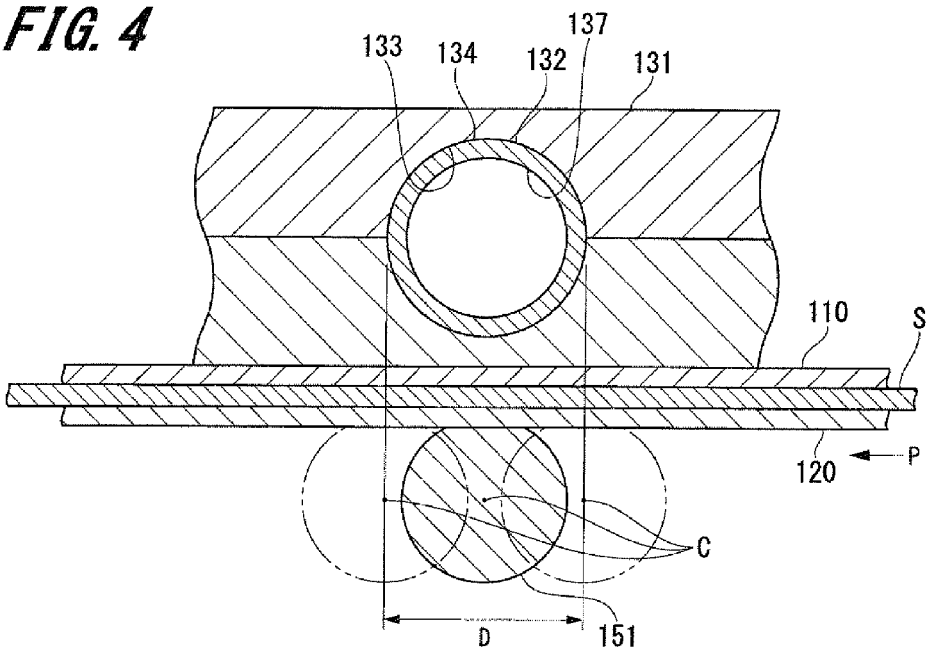
FIG. 4 is a diagram of a cross-sectional portion of an essential part, obtained by cutting the cooling device according to the first embodiment of the present invention, along the feeding direction of the sheets at a section where a diameter of a pressing roller is the maximum, and is a diagram explaining arrangement of a rotation center of the pressing roller with respect to a diameter of a cooling pipe body of the cooling device.
Figure 5:
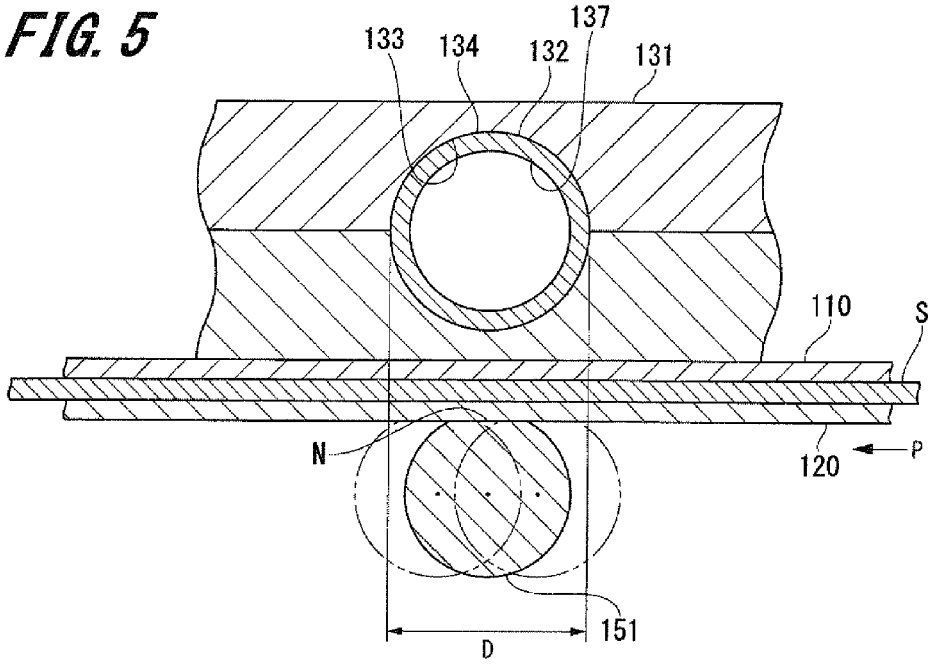
FIG. 5 is a diagram of a cross-sectional portion of an essential part, obtained by cutting the cooling device according to the first embodiment of the present invention, along the feeding direction of the sheets at the section where the diameter of the pressing roller is the maximum, and is a diagram explaining arrangement of a nip section between the pressing roller and a feeding belt with respect to the diameter of the cooling pipe body of the cooling device.

Subsequently, by referring to FIGS. 4 and 5, arrangement of the pressing roller 151 will be described. FIG. 4 is a cross-sectional view of an essential part, obtained by cutting the cooling device 100 along the sheet feeding direction at a section where the diameter of the pressing roller 151 is the largest, and is a diagram for explaining arrangement of a rotation center of the pressing roller 151 with respect to the diameter of the cooling pipe body 134. FIG. 5 is a cross-sectional view of an essential part, obtained by cutting the cooling device 100 along the sheet feeding direction at a section where the diameter of the pressing roller 151 is the largest, and is a diagram for explaining arrangement of a nip section between the pressing roller 151 and the feeding belt 120 with respect to the diameter of the cooling pipe body 134. Meanwhile, in FIGS. 4 to 5, reference character S denotes a sheet and an arrow P indicates the sheet feeding direction.

As illustrated in FIG. 4, the pressing roller 151 is arranged having a rotation center C of the pressing roller 151 located at the center of a region D in the present embodiment so that the rotation center C of the pressing roller 151 is located in the region D facing the diameter in the horizontal direction of the cooling pipe body 134. Meanwhile, in FIG. 4, a profile of the pressing roller 151 having the rotation center C located on the uppermost stream side and the lowermost stream side in the sheet feeding direction in the region D is indicated by a two-dot chain line.

In this way, by arranging the pressing roller 151, the sheet passing through the cooling device 100 can be brought closer to the cooling pipe body 134 in a state of being in close contact with the cooling belt 110. Therefore, cooling efficiency can be enhanced.

Moreover, as described in FIG. 5, in the pressing roller 151, a section in contact with the feeding belt 120, that is, a nip section N is arranged in the region D facing the diameter in the horizontal direction of the cooling pipe body 134 or at the center in the region D in the present embodiment. In FIG. 5, there is indicated, by a two-dot chain line, a profile of the pressing roller 151 when the nip section N is located on the uppermost stream side and the lowermost stream side in the sheet feeding direction in the region D.

In this way, by arranging the pressing roller 151, the sheet passing through the cooling device 100 can be brought closer to the cooling pipe body 134 in a state of being in close contact with the cooling belt 110. Therefore, cooling efficiency can be further enhanced.

In the cooling device 100 with the configuration described above and the image forming apparatus 1 provided with the cooling device 100, the pump 141 of the cooling device 100 supplies the cooling water to the cooling pipe unit 132 and causes the cooling water to flow from the downstream side to the upstream side in the sheet feeding direction. Thus, the sheet supplied from the upstream side of the feeding path A to the cooling device 100 is cooled by the cooling water flowing via the cooling pipe unit 132 through the cooling belt 110 and the cooling plate 131 while passing through the cooling device 100. Furthermore, since the cooling water flows through the cooling pipe unit 132 from the downstream side to the upstream side in the sheet feeding direction, there is kept a state in which a temperature difference between the sheet passing through the cooling device 100 and the cooling water is relatively large all the time, and thus, cooling efficiency by the cooling water is improved. Therefore, the sheet can be efficiently cooled.

Moreover, in the cooling device 100 with the configuration described above and the image forming apparatus 1 provided with the cooling device 100, the two sets of the cooling pipe units 132 are provided in parallel along the sheet feeding direction. Accordingly, a section which is cooled by the cooling water is relatively expanded, and thus the sheet can be cooled further efficiently.

Furthermore, to the two sets of the cooling pipe units 132 provided in parallel, the tank 140 and the radiator 142 are connected, respectively. Therefore, heat of the cooling water warmed by the sheet can be rapidly radiated and cooled. Accordingly, the sheet can be cooled further efficiently.

Moreover, the cooling pipe body 134 is fitted in the fitting hole 133 of the cooling plate 131, and the joining of the one end portions of the adjacent cooling pipe bodies 134 by the joining section 135 forms the flow passage 137, and thus it suffices that the fitting hole 133 is formed in the upper member 131*a* and the lower member 131*b* of the cooling plate 131. That is, it is not necessary to perform complicated processing on the cooling plate 131 in accordance with the shape of the cooling pipe unit 132. Thus, an increase of a manufacturing cost of the cooling device 100 and the image forming apparatus 1 can be prevented.

In addition, each of the four pressing rollers 151 is arranged at a position facing the cooling pipe body 134 via the feeding belt 120, the cooling belt 110, and the cooling plate 131. Therefore, the pressing roller 151 presses the sheet to the vicinity of the cooling pipe body 134 of the cooling plate 131 via the cooling belt 110. As a result, the sheet can be cooled further efficiently.

Furthermore, since the pressing roller 151 is formed in a crown shape, the pressing roller 151 can press the feeding belt 120 with a uniform force in a direction orthogonal to the sheet feeding direction.

Moreover, a length in the direction orthogonal to the sheet feeding direction on the horizontal plane of the pressing roller 151 is set longer than the length of the largest sheet fed by the cooling device 100 in the same direction. Therefore, since the pressing roller 151 can press the entire sheet in the direction orthogonal to the sheet feeding direction, the whole surface of the sheet can be uniformly cooled by pressing by the pressing roller 151.

In addition, the length in the direction orthogonal to the sheet feeding direction on the horizontal plane of the pressing roller 151 is set shorter than the length of the cooling plate 131 in the same direction. Accordingly, contact of the end portion in the same direction of the cooling plate 131 with the pressing roller 151 can be prevented, and damage on the pressing roller can be prevented from occurring.

Meanwhile, in the present embodiment, there has been explained the aspect in which the two sets of the cooling pipe units 132 are provided in parallel along the feeding direction of the sheet, but the number of the cooling pipe units 132 to be arranged can be changed as appropriate.

Furthermore, the cooling water cooled by the one set of the tanks 140, the pump 141, the radiator 142, and the fan 143 may be circulated to the plurality of cooling pipe units 132.

Second Embodiment

Figure 6:
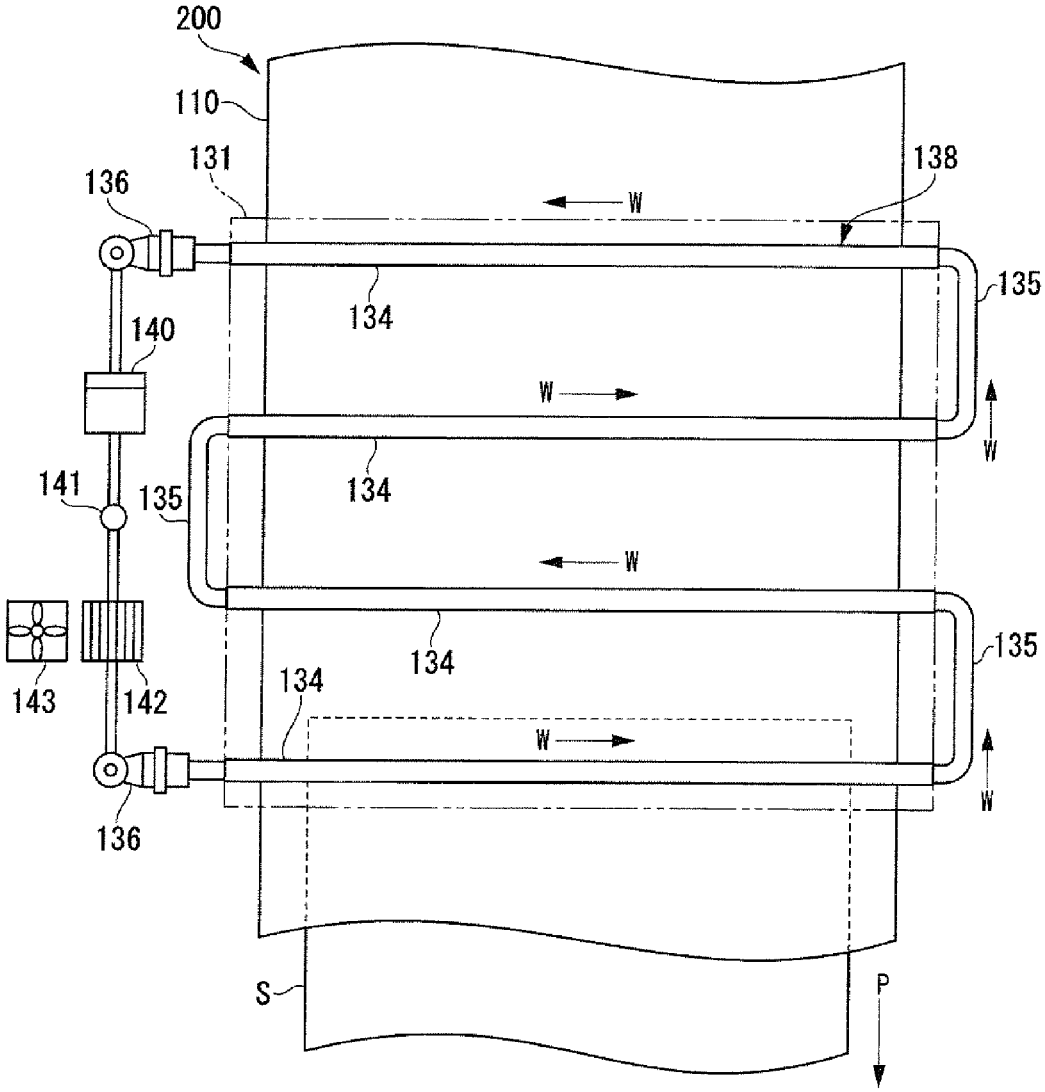
FIG. 6 is a top view of an essential part of a cooling device, when viewed from above, according to a second embodiment of the present invention.
Figure 7:
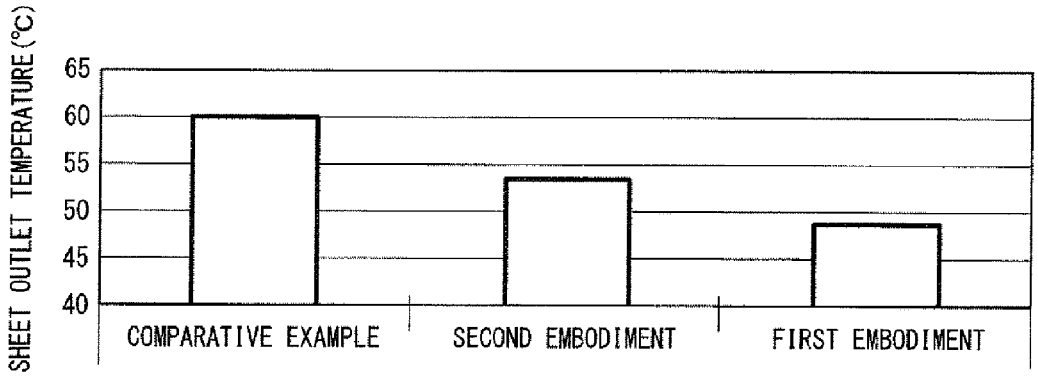
FIG. 7 is a diagram for explaining an effect of the present invention.

Subsequently, a second embodiment of the present invention will be described by referring to FIGS. 6 and 7. FIG. 6 is a top view of an essential part of a cooling device 200 according to the second embodiment of the present invention when viewed from above. FIG. 7 is a diagram for explaining an effect of the present invention. The cooling device 200 according to the second embodiment of the present invention is different from the cooling device 100 in the first embodiment in that a series of cooling pipe units 138 joined by a plurality of the joining sections 135 is employed. Meanwhile, the same reference numerals are attached to configurations common to the first embodiment and the explanation will be omitted. In addition, in FIG. 6, S denotes a sheet, the arrow P indicates a sheet feeding direction, and the arrow W indicates the flowing direction of the cooling water.

The cooling pipe unit 138 of the cooling device 200 has four cooling pipe bodies 134, three joining sections 135, and two connecting sections 136.

The joining section 135 extends in the sheet feeding direction, is bent at the both end portions in a direction orthogonal to the sheet feeding direction on the horizontal plane and is fixed to an end portion of the cooling pipe body 134. The joining section 135 joins the end portions of the adjacent cooling pipe bodies 134 to each other.

The connecting section 136 is provided to an end portion to which the joining section 135 of the cooling pipe body 134 is not fixed. In the cooling pipe bodies 134 joined by the joining section 135, the connecting section 136 provided to the cooling pipe body 134 arranged on the uppermost stream side in the sheet feeding direction connects the cooling pipe body 134 to the tank 140. Moreover, in the cooling pipe bodies 134 joined by the joining section 135, the connecting section 136 provided to the cooling pipe body 134 arranged on the lowermost stream side in the sheet feeding direction connects the cooling pipe body 134 to the radiator 142.

In the cooling device 200 configured as described above, the pump 141 supplies the cooling water from the tank 140 to the cooling pipe unit 138 during the image formation so that the cooling water flows through the flow passage in the cooling pipe unit 138 from the downstream side to the upstream side in the sheet feeding direction. Therefore, the cooling water supplied to the cooling pipe unit 138 first flows through the cooling pipe body 134 arranged on the lowermost stream side in the sheet feeding direction and subsequently, flows through the first joining section 135, and flows into the cooling pipe body 134 arranged second from the downstream side in the sheet feeding direction. Subsequently, the cooling water flows through the second joining section 135 joining the cooling pipe body 134 arranged second from the downstream side in the sheet feeding direction and the cooling pipe body 134 arranged third from the downstream side in the sheet feeding direction and through the cooling pipe body 134 arranged third from the downstream side in the sheet feeding direction. Subsequently, the cooling water flows through the third joining section 135 joining the cooling pipe body 134 arranged third from the downstream side in the sheet feeding direction and the cooling pipe body 134 arranged at the uppermost stream side and through the cooling pipe body 134 arranged on the uppermost stream side. Then, the cooling water is discharged from the flow passage via the connecting section 136 and stored in the tank 140.

In the cooling device 200 with the configuration described above and the image forming apparatus provided with the cooling device 200, there is no need to provide the tank 140, the pump 141, the radiator 142, and the fan 143 in a plural number. Thus, the sizes of the cooling device 200 and the image forming apparatus can be reduced, and the manufacturing cost can be reduced.

In the present embodiment, there has been explained the aspect in which the cooling pipe unit 138 of the cooling device 200 has the four cooling pipe bodies 134, the three joining sections 135, and the two connecting sections 136, but the number of the cooling pipe bodies 134 and the joining sections 135 to be installed can be changed as appropriate.

FIG. 7 is a diagram for explaining the effect of the present invention and illustrates a bar graph comparing a temperature of the sheet (sheet outlet temperature) detected by a temperature sensor (not shown) provided on the downstream side in the sheet feeding direction of the cooling device.

In FIG. 7, in the cooling device in which there is employed the cooling pipe unit 138 similar to the cooling pipe unit 138 in the second embodiment, a temperature of the sheet when the cooling water is caused to flow from the upstream to the downstream in the sheet feeding direction (hereinafter also referred to as a "comparative example") is indicated as the "comparative example." Furthermore, in FIG. 7, the temperature of the sheet measured in the cooling device 200 of the second embodiment is indicated as the "second embodiment" and the temperature of the sheet measured in the cooling device 100 of the first embodiment is indicated as the "first embodiment".

As illustrated in FIG. 7, the temperature (approximately 54° C.) of the sheet in the "second embodiment" is lower than the temperature (60° C.) of the sheet in the "comparative example". That is, the cooling device 200 in the second embodiment can cool the sheet more efficiently than the cooling device in the comparative example.

In addition, the temperature (approximately 49° C.) of the sheet in the "first embodiment" is lower than the temperature (60° C.) of the sheet in the "comparative example". That is, the cooling device 100 in the first embodiment can cool the sheet more efficiently than the cooling device in the comparative example.

The embodiments of the present invention have been described including their working effects. However, the cooling device and the image forming apparatus of the present invention are not limited to the aforementioned embodiments, but can be modified variously within a range not departing from the gist of the present invention described in the appended claims.

What is claimed is:

1. A cooling device used in an image forming apparatus, the cooling device comprising:

a feeding section having endless first belt and second belt faced with each other and feeding a sheet by sandwiching the same between the first belt and the second belt;

a cooling section having a flow passage-forming section for forming a flow passage through which a cooling medium flows and cooling the sheet via the first belt, the flow passage-forming section including a plurality of cooling pipe bodies, each extending in a direction orthogonal to a sheet feeding direction, and a joining section joining end portions of adjacent cooling pipe bodies to each other, and the flow passage being formed inside the plurality of cooling pipe bodies and the joining section; and a plurality of pressing rollers being provided inside the second belt, each of the plurality of pressing rollers being arranged at a position facing a corresponding cooling pipe body of the flow passage-forming section through the second belt and the first belt, and pressing the second belt onto the cooling section.

2. The cooling device according to claim 1, wherein the flow passage-forming section is formed so as to have a circular cross-sectional shape in a feeding direction of the sheet; and a rotation center of the pressing roller is located in a region facing a diameter in a horizontal direction of the flow passage-forming section.

3. The cooling device according to claim 1, wherein a nip section between the pressing roller and the second belt is located in a region facing a diameter in a horizontal direction of the flow passage-forming section.

4. The cooling device according to claim 1, wherein the pressing roller is formed of an elastic body capable of elastic deformation.

5. The cooling device according to claim 1, further comprising:

an adjustment section for adjusting a force pressing the second belt onto the first belt by moving the pressing roller in accordance with a paper thickness of the sheet.

6. The cooling device according to claim 1, wherein the cooling section has a contact surface in contact with the first belt;

a length of the contact surface in a direction orthogonal to a feeding direction of the sheet is larger than a length of the pressing roller in the direction orthogonal to the sheet feeding direction; and a length of the pressing roller in the direction orthogonal to the sheet feeding direction is larger than a length of the sheet being fed in the direction orthogonal to the sheet feeding direction.

7. An image forming apparatus comprising;

a cooling device, the cooling device comprising:

a feeding section having endless first belt and second belt facing each other and feeding a sheet by sandwiching the same between the first belt and the second belt;

a cooling section having a flow passage-forming section forming a flow passage through which a cooling medium flows and cooling the sheet via the first belt, the flow passage-forming section including a plurality of cooling pipe bodies, each extending in a direction orthogonal to a sheet feeding direction, and a joining section joining end portions of adjacent cooling pipe bodies to each other, and the flow passage being formed inside the plurality of cooling pipe bodies and the joining section; and a plurality of pressing rollers being provided inside the second belt, each of the plurality of pressing rollers being arranged at a position facing a corresponding cooling pipe body of the flow passage-forming section via the second belt and the first belt, and pressing the second belt onto the first belt.

* * * * *